US005144723A

United States Patent [19]

Hohloch et al.

[11] Patent Number: 5,144,723

[45] Date of Patent: Sep. 8, 1992

[54] DEVICE FOR ASSISTING THE TRANSFER OF A FLEECE FROM THE CARD MAIN CYLINDER TO THE DOFFER ROLL

[75] Inventors: Erich Hohloch, Winterthur; Hansruedi Fehr, Winterberg, both of Switzerland

[73] Assignee: Maschinenfabrik Rieter AG, Winterthur, Switzerland

[21] Appl. No.: 623,790

[22] Filed: Dec. 7, 1990

[30] Foreign Application Priority Data

Dec. 11, 1989 [CH] Switzerland ..... 04445/89

[51] Int. Cl.[5] ..... D01G 15/46; D01G 15/34

[52] U.S. Cl. ..... 19/106 R; 19/109

[58] Field of Search ..... 19/58, 95, 98, 106 R, 19/106 A, 109, 113, 203, 303, 304

[56] References Cited

U.S. PATENT DOCUMENTS

| | | | |
|---|---|---|---|
| 363,732 | 5/1887 | Dobson et al. | 19/106 R |
| 2,327,349 | 8/1943 | Goldsmith | 19/109 |
| 2,788,547 | 4/1957 | Kaufman et al. | 19/106 R |
| 2,987,779 | 6/1961 | Kawashima | 19/106 R |
| 3,283,366 | 11/1966 | Kalawaites | 19/106 R |
| 3,302,248 | 2/1967 | Johnson | 19/95 |
| 3,881,224 | 5/1975 | Wirth | 19/107 |
| 4,017,942 | 4/1977 | Clayton et al. | 19/106 R |
| 4,257,148 | 3/1981 | Vaughn et al. | 19/106 R X |
| 4,279,060 | 7/1981 | Wirth | 19/106 R |
| 4,332,058 | 6/1982 | Warnock | 19/106 R |
| 4,831,691 | 5/1989 | Hollingsworth et al. | 19/106 R X |

FOREIGN PATENT DOCUMENTS

| | | | |
|---|---|---|---|
| 127841 | 11/1899 | Fed. Rep. of Germany . | |
| 2252081 | 5/1974 | Fed. Rep. of Germany . | |
| 535856 | 4/1922 | France . | |
| 0712929 | 9/1966 | Italy | 19/106 R |
| 0384713 | 3/1960 | Japan | 19/106 R |
| 0003368 | of 1880 | United Kingdom | 19/106 R |
| 921789 | 3/1963 | United Kingdom . | |

OTHER PUBLICATIONS

Copy of the European Search Report Mar. 28, 1991.

*Primary Examiner*—Werner H. Schroeder
*Assistant Examiner*—Ismael Izaguirre
*Attorney, Agent, or Firm*—Sandler, Greenblum & Bernstein

[57] ABSTRACT

In order to optimally control the air supply in a diverging gap between a card main cylinder and a doffer roll, an air guide plate with a predetermined spacing on the narrowest part between the air guide plate and the surface of the main cylinder and with an aperture angle is arranged close to the main cylinder so that a converging gap is provided between the air guide plate and the surface of the main cylinder. In this converging gap, a pressure head builds up in operation through the air conveyed from the surface of the main cylinder, which leads to an overflow over a nose of the air guide plate. This overflow helps the fleece, which is loosened from the main cylinder, to more easily reach the doffer surface. In order to control the quantity of overflowing air, the gap is to be determined by trial. The air passing through the gap may be taken up from a conduit shaped foot part, which can be connected to a vacuum source, for withdrawing particles of dirt which arrive in the conduit and, and to control the vacuum in the conduit. This pressure control may be effected through a throttle valve inserted between the conduit and a vacuum source. Subsequently, on the conduit, a series of card rods may be arranged in the direction of rotation of the main cylinder.

21 Claims, 5 Drawing Sheets

DEVICE FOR ASSISTING THE TRANSFER OF A FLEECE FROM THE CARD MAIN CYLINDER TO THE DOFFER ROLL

CROSS-REFERENCE TO THE RELATED APPLICATION

This application claims the priority Swiss Application No. 04 445/89-5 filed Dec. 11, 1989, which is incorporated herein by reference.

BACKGROUND OF THE INVENTION

1. Field of the Invention

The present invention is related to a card with a main cylinder on which fleece to be carded is lying, and with a doffer roll, also known as a doffer, with which the carded fiber layer is taken over as fleece. The card is provided with a diverging gap between the main cylinder and the doffer roll that extends over the whole width of the main cylinder, with an air guide plate which forms a diverging gap with the surface of the main cylinder so that the air flowing into the diverging gap is guided by the air guide plate in such a way that the transfer of the fleece to the doffer roll is assisted.

2. Description of the Related Art

An air guide plate of the above-mentioned type has already been provided on Applicant's own commercial carding machines in order to assist the transfer of the fiber fleece from the surface of the main cylinder to the doffer roll.

Such machines, however, are a type in which the air guide plate is provided as a rim of the cover plate, as seen in the peripheral direction of the main cylinder in the immediate carding zone, and which is arranged with a predetermined spacing against the surface of the main cylinder and the doffer surface. The exact setting of the part has to be adjusted each time by means of time consuming trial and error, and is only applied to predetermined parameters, such as the main cylinder rotational speed, for example, and to the material to be processed.

The air carried along the main cylinder surface is thereby conveyed in the existing converging gap between this air guide plate and the main cylinder surface and subsequently in the narrowest gap; that is, in the gap between the above-mentioned cover plate and the main cylinder surface.

The disadvantage of this arrangement is that the air relationship in the diverging gap between the main cylinder surface and the doffer surface and, likewise, on the free end of the air guide plate are different, depending on the air current in the gap between the surface of the main cylinder and the cover plate, which has a variable effect on the guiding of the fleece from the surface of the main cylinder to the surface of the doffer roll.

This effect changes, for example, with the thickness of the main cylinder clothing and the doffer clothing, with the peripheral speed, and also with the air relationship in the intermediate carding zone between the surface of the main cylinder and the plate covering this surface.

SUMMARY OF THE INVENTION

It is, therefore, an object of the invention to obviate this disadvantage; that is, to optimize the air relationship in the diverging gap between the main cylinder surface and the doffer surface and on the free end of the air guide plate so that, with a once predetermined position of the air guide plate, the air current in the diverging gap remains substantially constant, and to maintain through this the influence on the fleece guidance from the main cylinder surface and the doffer surface as substantially constant.

An advantage of the invention lies in the fact that the air current relationship set in the diverging gap between the main cylinder surface and the doffer surface can be altered in a simple way and that the flow relationships can be maintained as constant through the measures explained in more detail below.

Therefore, according to one aspect of the invention, a card comprises a main cylinder on which a fleece to be carded is adapted to lie; a doffer roll with which the carded fiber layer is removed from the main cylinder as a fleece; a diverging gap between the main cylinder and the doffer roll which extends over the entire width of the main cylinder; an air guide plate which forms a converging gap having an aperture angle with the surface of the main cylinder so that air flowing into the converging gap is guided by the air guide plate so that the transfer of the fleece to the doffer roll is thereby assisted.

The air guide plate includes an independently movable element having at least one predetermined degree of freedom and a free space of predetermined size is provided immediately following the air guide plate, in the direction of rotation of the main cylinder According to another aspect of the invention, a first degree of freedom is provided, wherein said air guide plate is arranged to slide away from and towards the main cylinder surface in such a manner that the narrowest part of the spacing of the converging gap is adjustable. A second degree of freedom may be provided, wherein the air guide plate is additionally pivoted to swivel, so that the aperture angle of the converging gap is adjustable. A third degree of freedom may be provided, where the predetermined angle of the air guide plate is changed by the air guide plate being arranged to slide in the horizontal direction away from and towards the main cylinder surface, wherein the narrowest portion of the spacing of the converging gap and the aperture angle are adjustable.

The free space may be limited through a further means for guiding. The means for guiding can slide so that said free space is adjustable in size. The free space can also be placed under vacuum so that a predetermined vacuum is produced in the free space.

The free space can also be supplied with air so that a predetermined pressure is produced in the free space. The vacuum or the pressure of the air may be adjustable by a control throttle provided between the respective vacuum source or the air pressure source and the free space.

According to another aspect of the invention, driving means may enable the adjustment of at least one of the degrees of freedom of the air guide plate or the pressures of the air in the converging gap. Such driving means may be a manually actuated driving means.

The present invention is also directed to a method of delivering a fiber fleece from a card main cylinder to a doffer roll, and includes the steps of:

supervising the movement of the fiber fleece from the main cylinder to the doffer roll to determine a predetermined movement; and correcting the deviations from the predetermined movement, until the predetermined movement is again achieved.

The movement is supervised optically, such as by a light source, or visually. The deviation from the predetermined movement may be corrected manually.

According to another aspect of the invention, at least one window is provided in a card side wall in the space between the main cylinder and the doffer roll, so that the movement of the fiber fleece can be optically or visually supervised through the at least one window.

A gap is provided adjacent the main cylinder and doffer roll, and the size of the gap is adjusted to change the air pressure within the gap, whereby the resulting air flow aids in delivering the fiber fleece to the doffer roll. An adjusted air guide plate is provided to guide the resulting air flow and a free space is provided immediately following the air guide plate.

BRIEF DESCRIPTION OF THE DRAWINGS

The invention is further explained in the description which follows with reference to the drawings illustrating, by way of non-limiting examples, various embodiments of the invention wherein.

DESCRIPTION OF THE PREFERRED EMBODIMENTS

Figure 1:
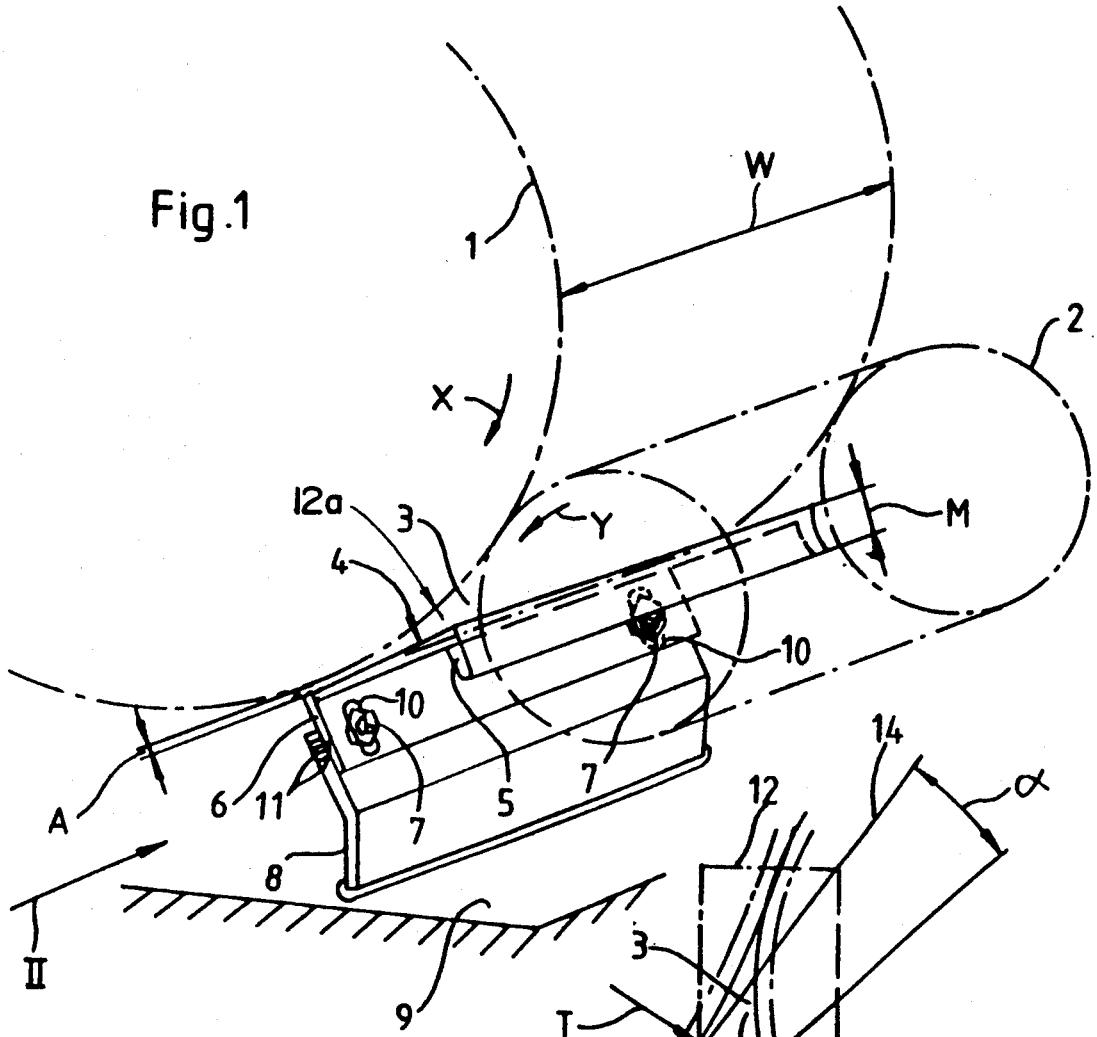
FIG. 1 is a perspective schematic representation of the device according to the invention.

FIG. 1 schematically illustrates a card main cylinder 1, which is only partially represented and indicated with dash-dotted lines, and a doffer roll 2 which is also represented schematically with dash-dotted lines. The directions of rotation of the main cylinder, the doffer roll are designated by arrows X and V, respectively.

An air guide plate 4 projects into the diverging gap 3 between the card main cylinder 1 and the doffer roll 2. A nose 5 is provided on the free end of the air guide plate 4 and extends in the direction of rotation of the doffer roll 2.

The air guide plate 4 together with the nose 5 extends over the entire width W of the main cylinder and of the entire width of the doffer roll.

Furthermore, the air guide plate 4 includes a foot part 6, which is fastened by means of screws 7 on a support 8 which is fixed at its end to a machine frame part 9.

Figure 2:
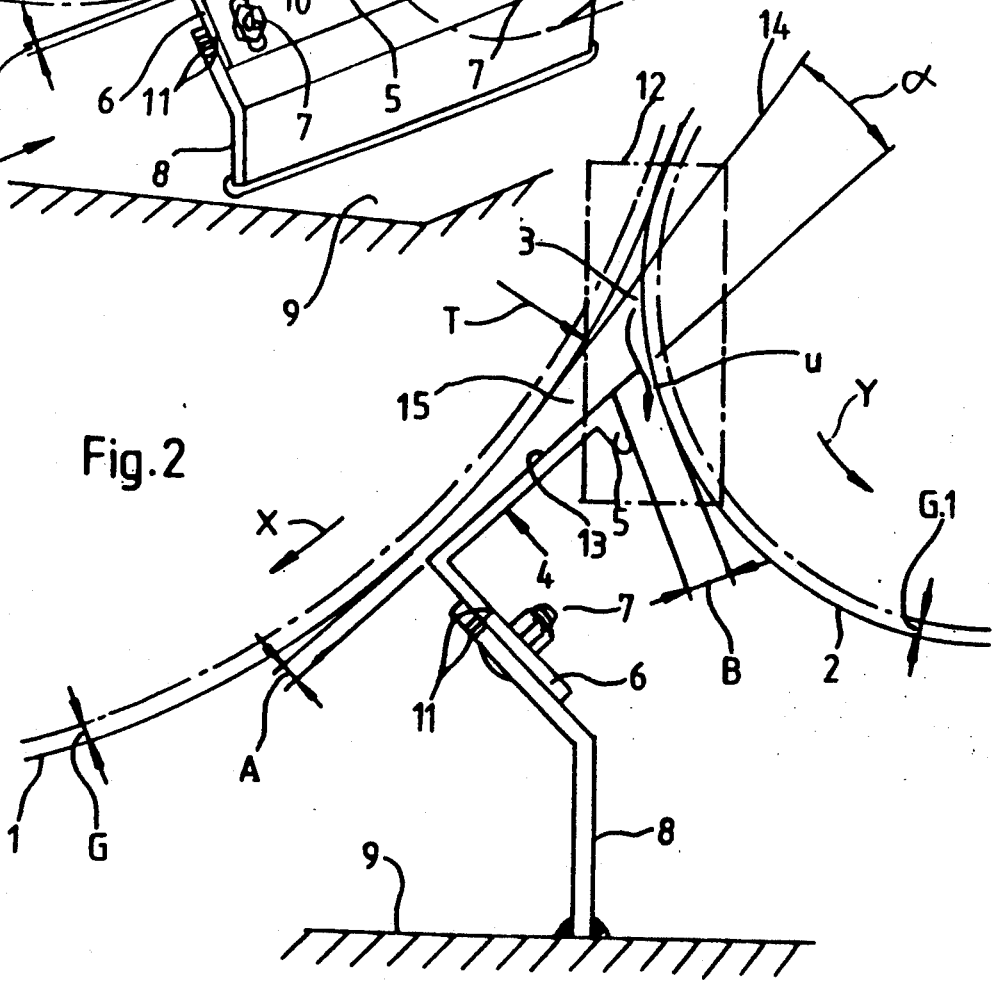
FIG. 2 is a front view of the device of FIG. 1 taken in the direction of arrow II (FIG. 1) and represented on an enlarged scale.

As can be seen in FIGS. 1 and 2, air guide plate 4 has a predetermined spacing A from the main cylinder 1. The surface of the main cylinder 1, and that of the doffer 2, is represented with dash-dotted lines in FIG. 1 and with full lines in FIG. 2. Thereby, these surfaces signify the total of all the needle points of the clothing on the main cylinder and the doffer roll. That is the spacing A is taken exactly as the spacing between the narrowest part of the air guide plate 4 and the needle points of the main cylinder clothing.

The term clothing is well known and is not further explained here. It is only mentioned that the clothing can comprise either all steel or wire clothing.

In order to enable adjustment of the spacing A, the foot part 6 has slots 10, so that the foot part 6, in which the screws 7 are inserted, can slide in relation to the support 8 in the direction towards the main cylinder surface or away from such surface.

In order to facilitate this setting, the foot part 6 and the support 8 are provided with measurement grooves 11 on both front surfaces thereof, although such grooves are only visible on one front surface in the drawings.

Such measurement grooves are known in the art of measuring tools, for example (e.g. slide calipers).

Furthermore, the nose 5 is spaced an amount B from the doffing roll 2 surface. This spacing is specified empirically and is determined by trial. The alteration of this spacing B, because of alterations of the spacing A, is negligible.

Furthermore the length M of the nose 5 must be initially determined by trial.

As already mentioned, in FIG. 2, contrary to FIG. 1, the surface of the main cylinder 1 and the surface of the doffer roll 2 is not represented with dash-dotted lines but rather with full lines. The dash-dotted lines in FIG. 2, which are concentric to these full lines, represent the depth G of the main cylinder clothing, or the depth G.1 of the clothing of the doffer roll.

Furthermore, in FIG. 2, a window 12 is represented by a dash-dotted rectangle. This window is provided in both the so-called card shells, which cover the two front faces of the main cylinder, and of the doffer roll, respectively. The card shells are also the supports for the pivot bearings of these elements. Window 12 facilitates the manipulation of the air guide plate 4.

Instead of a window, a light source 12*a* can be inserted, in order to optically illuminate the diverging gap 3, or the path of the fleece from the main cylinder to the doffer.

An aperture angle alpha ($\alpha$) of the air guide plate 4 is formed, on the one hand, through one of the opposed surfaces 13 of the air guide plate 4 of the main cylinder and on the other hand, through an imaginary tangential plane 14, located on the main cylinder surface. Thereby, the tangential plane is situated on that plane on the genatrix of the main cylinder surface which is opposite to the outermost edge of the air guide plate 4, and which is designated with the arrow T.

The aperture angle alpha in this embodiment, contrary to embodiments described later, is empirically specified and is predetermined through trial.

In operation, the main cylinder surface, as well as the doffer surface, though in a reduced measure, guide air in the direction of rotation X or V, and which flows in the converging gap 15, which is formed by the surface of the main cylinder and the surface 13. Through this air flow, a pressure head exists in the converging gap 15, which becomes greater or smaller, according to the size of the spacing A.

According to the size of the pressure head and the size of the aperture angle alpha, there is substantial air overflow U over the nose 5 that is in the direction of rotation of the doffer, which, with a correctly selected pressure head and correctly chosen aperture angle alpha, results in the overflowing air aiding in conveying the fleece from the main cylinder onto the doffer. Accordingly, the direction and intensity of the overflowing air can be altered through the setting of the aperture angle alpha and through alteration of the spacing. Thereby, the aperture angle alpha once determined is not further altered substantially in this embodiment.

Figure 3:
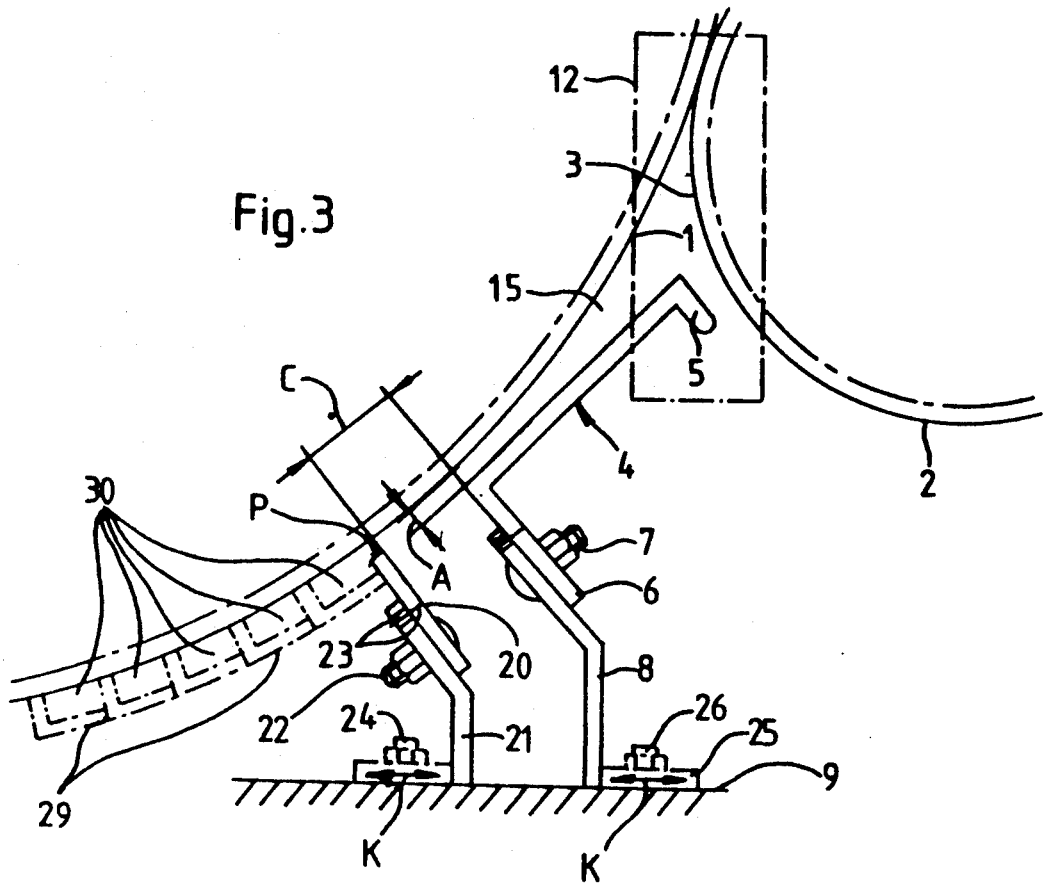
FIGS. 3 and 4 are each a further embodiment of the device of FIG. 2.

FIG. 3 illustrates a modification of the device of FIGS. 1 and 2 in which, in addition to the air guide plate 4 shown and described in FIGS. 1 and 2, another air wall 20 of air guide plate 4 is provided opposite to foot part 6, which has a spacing C from the foot part 6. This air wall 20 is likewise adjustable in the same manner as the air guide wall 4, and is fastened on a carrier 21 by means of screws 22. The adjustment can likewise be facilitated by means of measurement grooves 23. The carrier can either be rigidly fixed on the machine frame part 9 or fixed by means of screws to machine frame 9, which are guided in slots of the carrier part fixed on the machine frame. Through this, the carrier part 21 is arranged to slide in the direction of arrow K.

This also applies to the support 8, which is either rigidly fixed to the machine frame part 9 as shown in FIG. 2 or rigidly screwed on the machine frame part 9 by means of the foot 25 and screws 26 (FIG. 3). Slots can also be in the foot 25 in which the support 8 can slide and be guided by the screws 26.

By the possibility of being able to slide the support 8 in the direction K, the opportunity of changing the angular aperture alpha is obtained by the simultaneous sliding of the air guide plate 4.

The air wall 20 also extends over the entire width W of the main cylinder and through the previously mentioned covers or shells (not shown) provided on the front face of the main cylinder. The main cylinder is thereby covered and forms an opening as described below.

By the above-described arrangement, an opening or conduit exists between the air wall 20, the foot part 21, the support 8, and the air guide plate 4, in which the dirt separated (e.g., dust, short fibers, and husk fragments) can collect.

The conduit or opening must have an opening cross section which is not smaller than the cross sectional area which is formed by the spacing A and the main cylinder length L.

Moreover, the conduit may be connected to a vacuum source (not shown) and its cross section may be dimensioned in such a way that the conduit is substantially in a predetermined vacuum over its entire length.

It is an advantage for this vacuum to be adjustable through an adjustable throttle (not shown, but well known in the art). By means of a throttled suction of this type, an additional possibility of adjusting the pressure head in the converging gap 15 exists.

Figure 4:
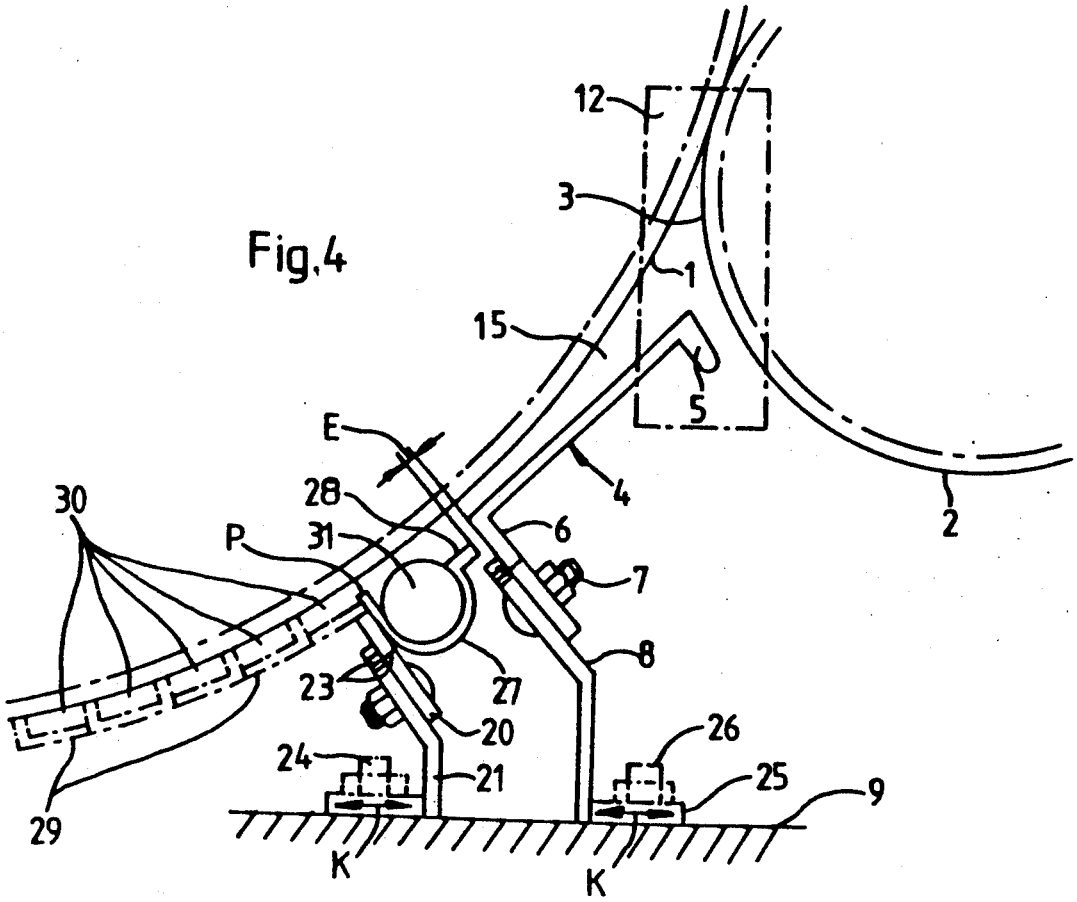

Furthermore, the conduit suction can be designed in such a way that dirt in the conduit can be removed pneumatically. An advantageous embodiment is shown in FIG. 4, wherein another collection conduit 27 is provided on the air wall 20.

Conduit 27 is shaped substantially like a roof gutter, and is formed with a lip 28. Lip 28 is spaced an amount E from the foot part 6 of the air guide plate 4.

Conduit 27 is provided with a suction opening 31 and is also connected, via a subsequent adjustable throttle (not shown), to a vacuum source, so that the separated dirt in the conduit 27 can be sucked out.

Since infiltrated air can be sucked through the space E, the opportunity exists for obtaining sufficient air which is necessary for the formation of the correct pressure head in the converging gap 15 for the removal of the dirt, without the vacuum in the conduit 27 being above a desirable level. Additionally, the space located under the conduit 27 (with regard to FIG. 4) must have an air inlet for the admittance of atmospheric air.

The space E can be adjusted through the adjustability of the foot 21 and of the support 8 by sliding each in the direction K.

Furthermore, the wall 20 (FIG. 3) or the conduit 27, do not lie on the surface of the main cylinder, but rather include a safety spacing P.

For this reason, still more sealing elements are illustrated in FIGS. 3 and 4, which have the object of throttling air conveyed in the direction of rotation of the main cylinder and entering through the gap P into the clothing of the main cylinder, in the case where this air has too great an influence on the pressure head in the converging space 15.

This sealing element 29 can be a labyrinth seal; that is, the body of the sealing element shown has empty conduit spaces 30, from which the air can flow out from the open ends of the sealing elements.

Alternatively, conduit spaces 30 may be filled with a fine fiber felt, which is profiled by the card clothing before the actual carding process in such a way that the felt surface directed against the clothing corresponds to the surface of the clothing. Through the roughened surface, a rough, turbulence-producing surface results, which impedes the through flow of the air.

Figure 5:
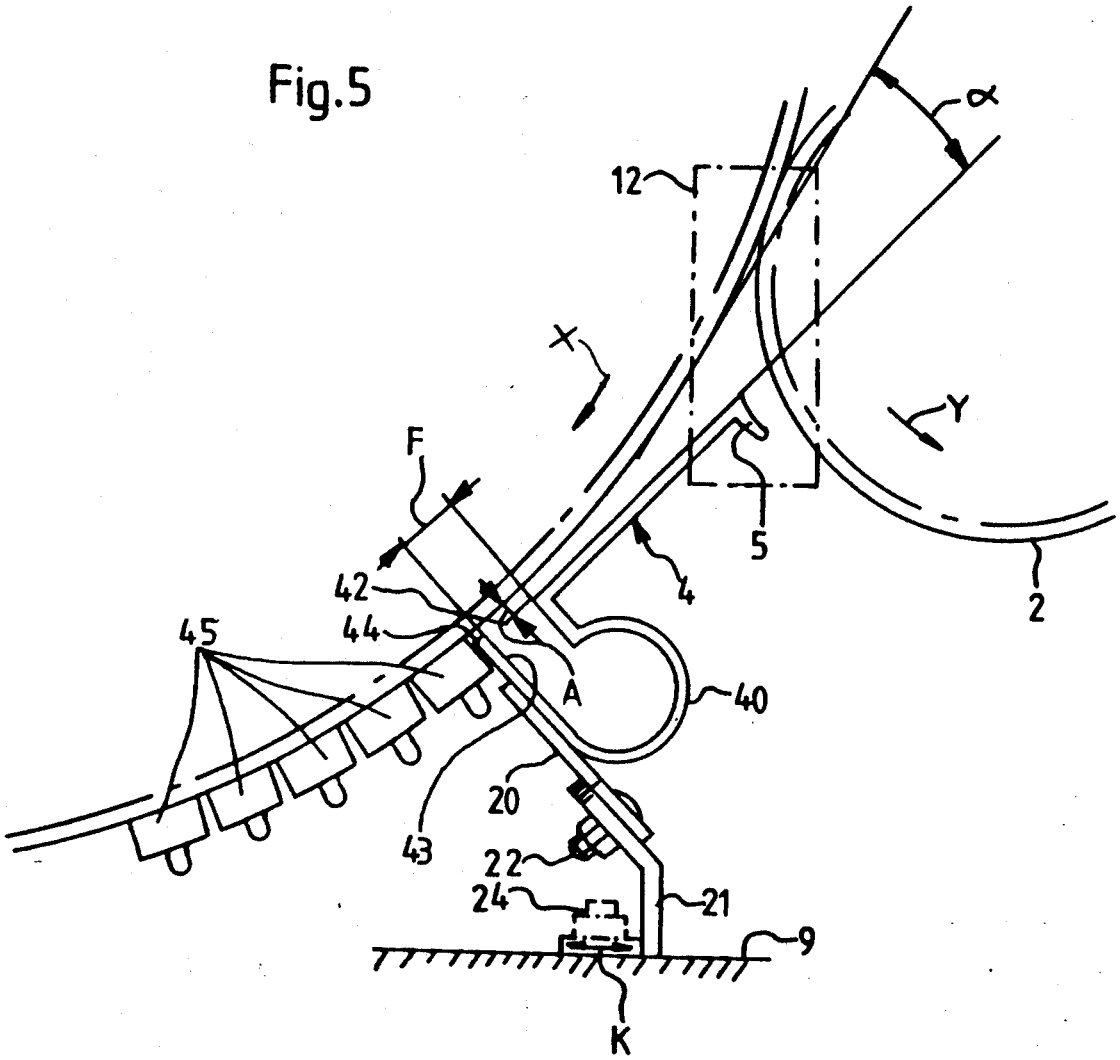
FIG. 5 is a front view of a still further embodiment of the device according to the invention.

As a further alternative, instead of the sealing element 29, carding rods maybe fitted in the same location as the seals, whereby the number of caring rods must be determined by trials (see FIG. 5).

Such sealing elements 29 or carding rods can also be used with the arrangement of FIGS. 1 and 2 instead of the wall 20 shown in FIG. 3, whereby the predetermined spacing (not shown) is arranged between the foot part 6 of the air guide plate 4 and the first element 29 of the arrangement of the first carding rod. This spacing (not shown) must likewise be determined through trial.

FIG. 5 shows a further embodiment, in which the air guide plate 4 is provided with a conduit shaped addition 40 which is fastened on the wall 20.

The conduit shaped addition 40 has a conduit opening 42 with an opening width F, which is directed towards the surface of the main cylinder.

The converging gap 15 discharges into the conduit opening 42 and includes a spacing A.

The conduit shaped addition 40 is the same length as the air guide plate 4 and is closed on one face and can have a connection to a vacuum source on the opposite front face, whereby in such a case, as described above, it is preferable if an adjustable throttle valve is provided between the vacuum source and the conduit shaped addition 40.

A wall 43 lying opposite to the foot part of the air guide plate 4, which is a component of the conduit shaped addition 40, extends to a predetermined spacing from the main cylinder (not shown, however, in substantially the same manner as the space P in FIGS. 3 and 4).

Carding rods 45 are provided and are supported on wall 43, which, as already mentioned, maintain a sealing function to the surface of the main cylinder.

In order to obtain infiltrated air in the conduit shaped addition 40, a variable, throttled infiltrated air opening (not shown but well known in the art) can be provided on the closed side of the front face of the addition 40.

Figure 6:
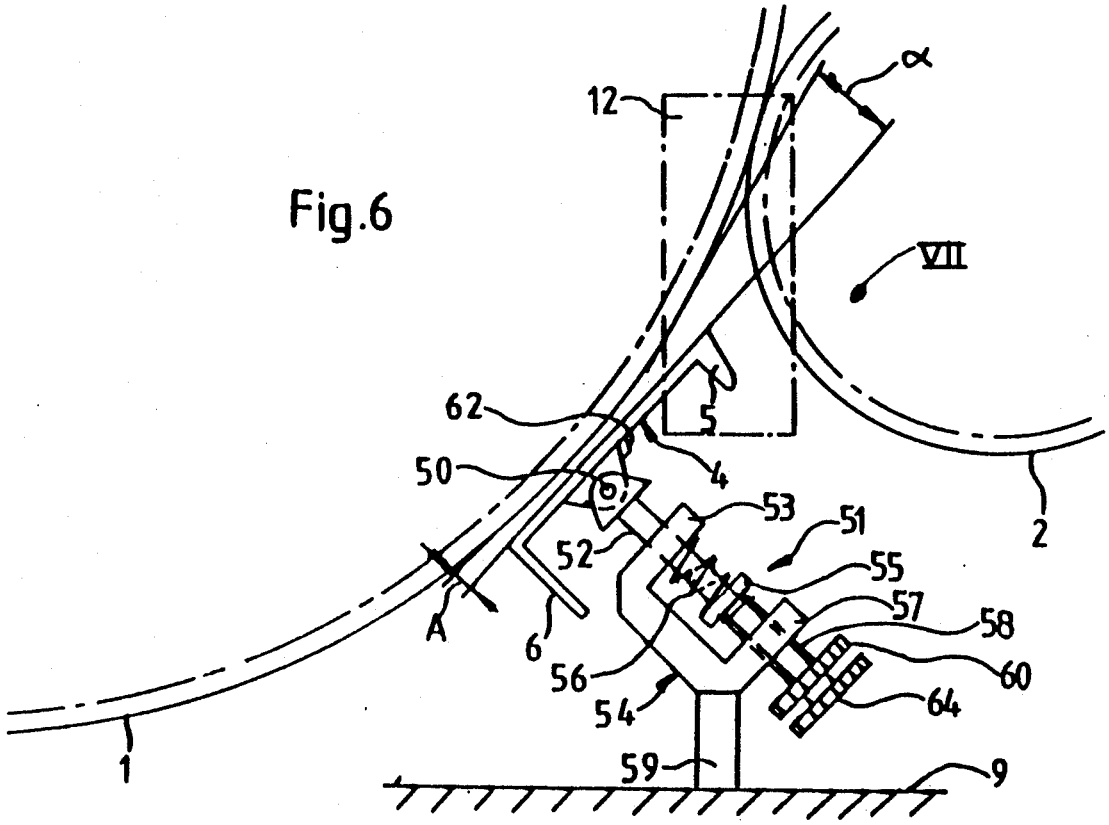
FIG. 6 is a front view of a further embodiment of the device according to the invention.

FIG. 6 illustrates a further embodiment, wherein the air guide plate 4 is arranged to swivel on an adjustment mechanism 51 by means of a swivel pin 50.

The adjustment mechanism comprises therewith a displacement piston 52, which is supported to slide in an arm 53 of a supporting element 54. The swivel pin 50 is pivoted on displacement piston 52.

The displacement piston 52 includes a plate 55 on the end opposite to the swivel pin 50, plate 55 being rigidly connected with the displacement piston 52. A compression spring 56 is provided on the displacement piston 52 between the arm 53 and the plate 55.

A second arm 57 lying opposite to first arm 53 also is part of carrier element 54, and serves to receive a threaded spindle 58. The carrier element 54 is fastened by means of a column 59, which is fixed on machine frame part 9.

Figure 7:
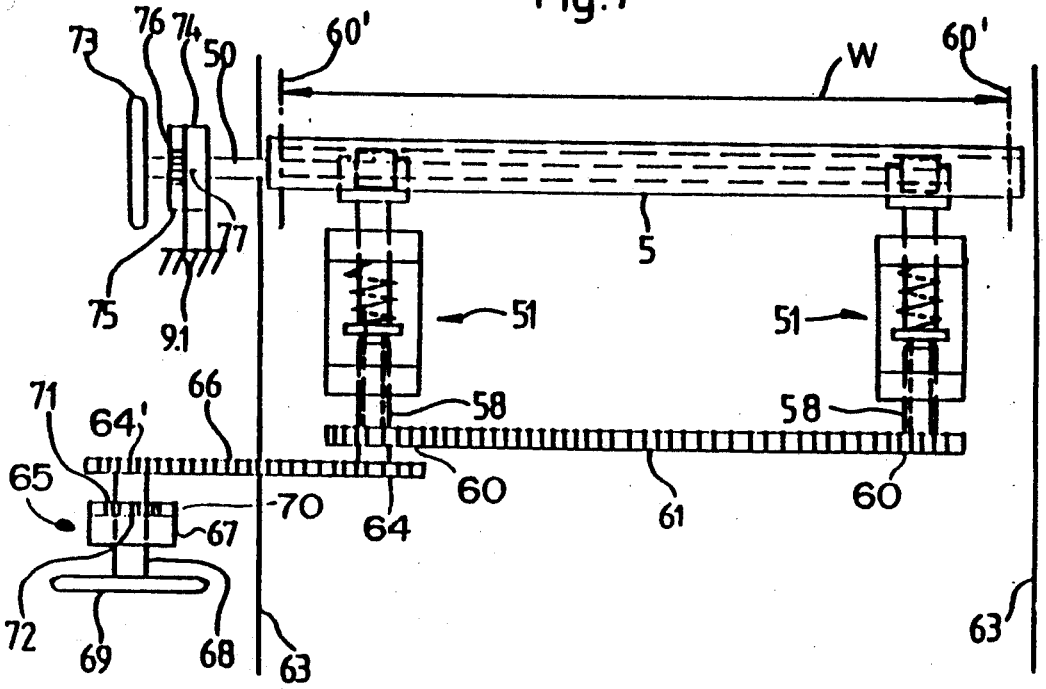
FIG. 7 is a view of the device of FIG. 6, taken in the direction of arrow VII (FIG. 6)

FIG. 7 illustrates a top view in the direction of arrow VII in FIG. 6, whereby, for the sake of increased clarity, the doffing drum is deleted and the main cylinder is only indicated by means of the dashed line 60'. Thereby, L is the length of the main cylinder 2.

Furthermore, as can be seen from FIGS. 6 and 7, a chain wheel 60 is fixed on the free end of the threaded spindle 58, which in the arrangement shown in FIG. 7, is connected with two adjustment mechanisms 51 through a chain 61.

By turning the spindle 58, the air guide plate 4 can be displaced towards and away from the main cylinder surface, so that the spacing A can be altered. Furthermore, the swivel pin 50 is connected rigidly with a shackle 62 on the air guide plate 4, so that the aperture angle alpha can be altered by turning the swivel pin.

As the two adjusting mechanisms 51 are located inside the front side carding machine coverings 63, the possibility of adjusting the spindle 58 from outside the card covering is an advantage.

In order to accomplish this adjustment, a further chain wheel 64 is provided on the chain wheel 60 of the left hand (with reference to FIG. 7) adjustment mechanism 51, and outside the left hand card covering 63, a rotation mechanism 65 is provided. The chain wheel 64' of which is connected with the chain wheel 64 through a chain 66.

The rotation mechanism 65 thereby comprises a bearing body 67 which is rigidly connected with a machine frame part in which a shaft 68 is journalled. Chain wheel 64' is fastened on the free end of shaft 68 and a handwheel 69 is fixed on the other free end.

Furthermore, a measurement disc 70 directly adjacent the bearing body 67 is rigidly fixed with the shaft 68. This measurement disc 70 is supported directly on a front face of the bearing body 67 and has measurement grooves 71. Measurement grooves 72 are also provide on the bearing body 67.

In this manner, it is possible to turn the spindle 58 to the desired position by means of the handwheel 69 and, with the aid of the measurement grooves 71 and 72, to set the spacing A at a desired magnitude.

As also to be seen in FIG. 7 the swivel pin 50 is connected with a handwheel 73, so that the swivel pin 50 is also rotatable from outside the card covering.

Upon rotation of handwheel 73 of swivel pin 50, the swivel pin 50 pivots in a bearing body 74. The bearing body 74 is rigidly connected with the machine frame part 9.1. The other end of the swivel pin 50 pivots in the right hand card covering 63 (with reference to FIG. 7).

In the same way as for the adjustment of the spindle 58 by means of the handwheel 69, a measurement disc 75 is rigidly secured to swivel pin 50, on which measurement grooves 76 are provided. Also, measuring grooves 77 are also provided on the bearing body 74. In operation, both the spacing A and the aperture angle can be adjusted by means of the handwheels 69 and 73.

It is possible by means of the window 12 and a light source positioned opposite thereto, to observe the behavior of the fleece, which moves from the main cylinder to the doffer roll and to influence the movement of the fleece by adjusting the aperture angle alpha and the gap width A and/or to change the vacuum, in an embodiment in which this is possible.

Figure 8:
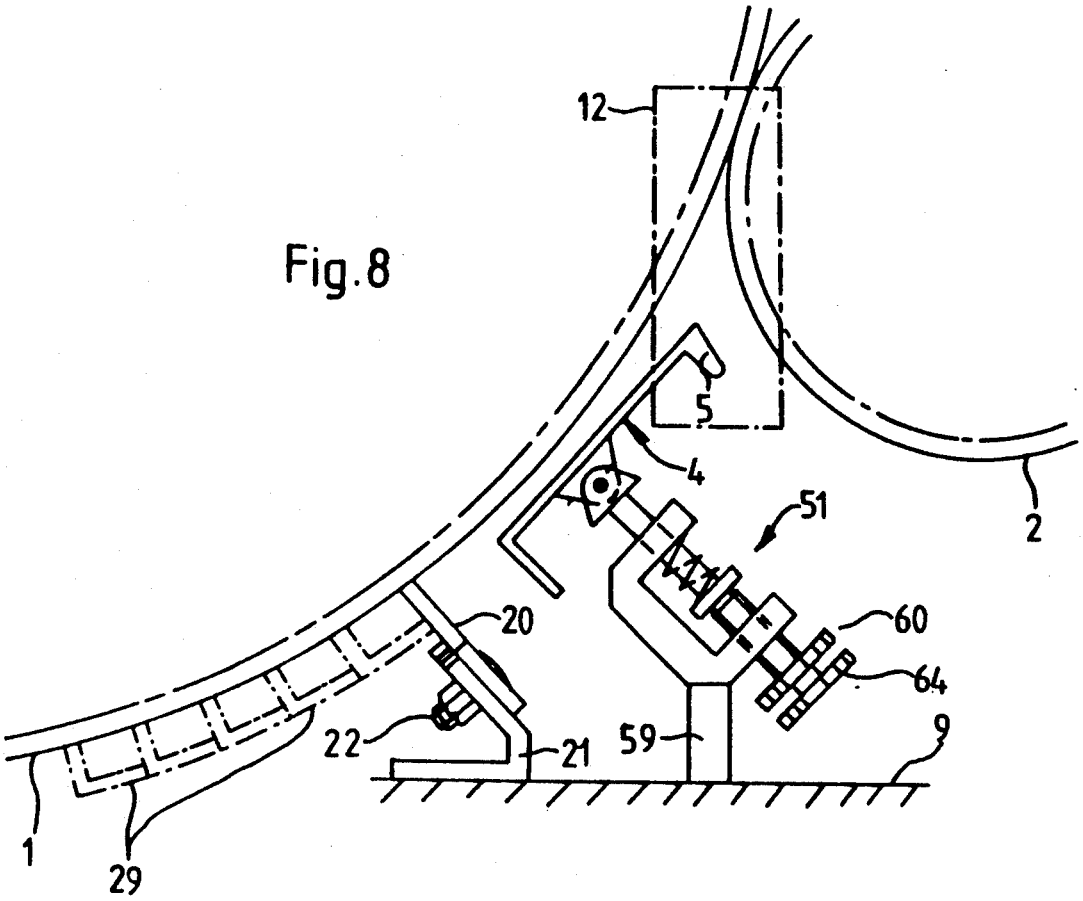
FIG. 8 and 9 a modifications of the device of FIG. 6.
Figure 9:
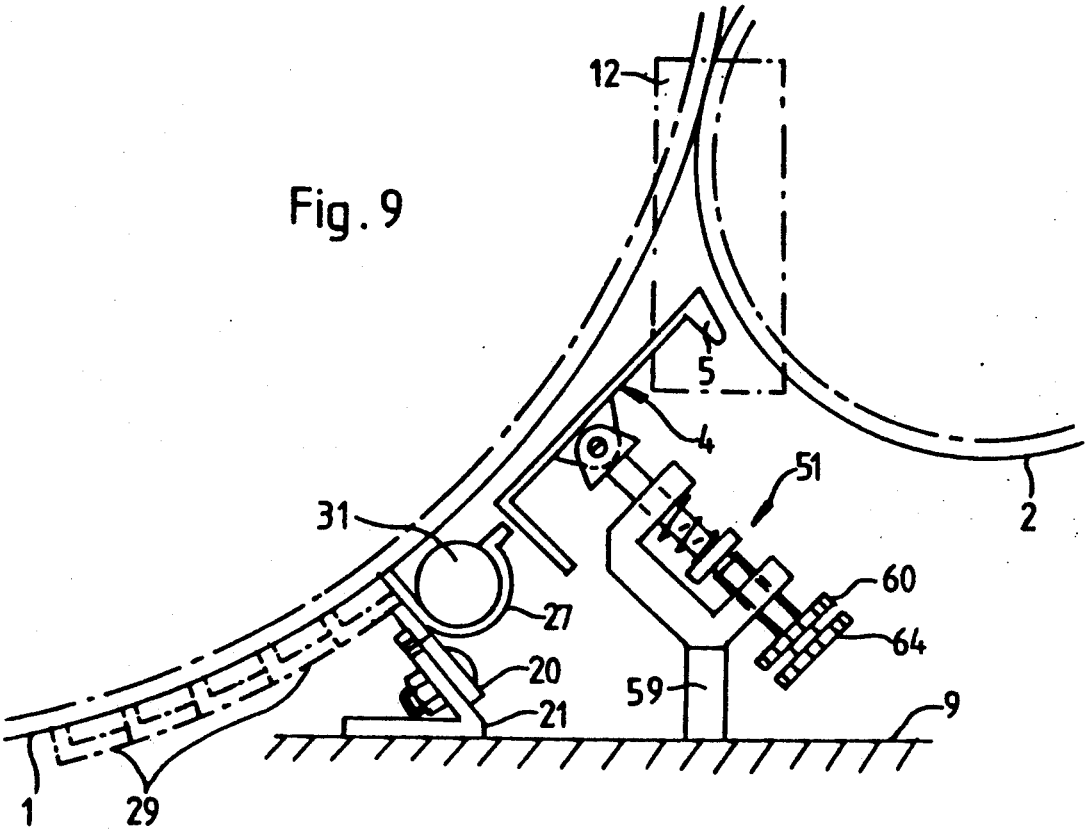

Referring to FIGS. 8 and 9, in which known elements are designated with the same reference symbols, the adjusting mechanism 51 as illustrated with the guide plate 4 on it, and can also be combined with the elements shown in FIGS. 3 and 4. For this reason, a further description is omitted and reference is made to the same reference symbols in FIGS. 8 and 9 as are shown in FIGS. 3 and 4, in order to illustrate point that it is a matter of the same elements being used in a somewhat more suitable form.

Finally, in those embodiments in which free space in the connection on the air guide plate, seen in the direction of rotation of the main cylinder, can be placed in a vacuum, that this space, through suitable pressure sources, can be placed under pressure or at least temporary overpressure. For example, when starting the card, in order to divert the fleece against the doffer by means of an air current in the opposite direction to the direction of rotation of the main cylinder, for so long as no adequate pressure head has built up as a result of the lower rotational speed of the main cylinder, or for temporary cleaning purposes.

The present disclosure relates to subject matter contained in Swiss Patent Application No. 04 445/89-5 (filed Dec. 11, 1989), which is herein incorporated by reference in its entirety.

Although the invention has been described with reference to particular means, materials and embodiments, it is to be understood that the invention is not limited to the particulars disclosed and extends to all equivalents within the scope of the claims.

What is claimed:

1. A card comprising:

a main cylinder on which a fleece to be carded is adapted to lie;

a doffer roll with which the carded fiber layer is removed from said main cylinder as a fleece;

a diverging gap between said main cylinder and said doffer roll which extends over the entire width of the main cylinder;

an air guide plate which forms a converging gap having an aperture angle with the surface of the main cylinder such that air flowing into said converging gap is guided by said air guide plate so that the transfer of the fleece to the doffer roll is thereby assisted;

said air guide plate comprising an independently movable element having at least one predetermined degree of freedom of movement; and a free space of predetermined size being provided immediately following the air guide plate, in a direction of rotation of the main cylinder.

2. Card according to claim 1, wherein a first degree of freedom is provided, wherein said air guide plate is positioned with respect to said main cylinder surface to slide away from and towards said main cylinder surface in such a manner that a narrowest part of the spacing of said converging gap is adjustable.

3. Card according to claim 2, wherein a second degree of freedom is provided, wherein said air guide plate is additionally pivoted to swivel, so that the aperture angle of the converging gap is adjustable.

4. Card according to claim 2, wherein a third degree of freedom is provided, wherein said predetermined angle of said air guide plate is changed by said air guide plate being positioned with respect to said main cylinder surface to slide in a horizontal direction away from and towards said main cylinder surface, wherein the narrowest portion of the spacing of said converging gap and the aperture angle are adjustable.

5. Card according to claim 2, comprising driving means for adjusting at least one of the degrees of freedom of said air guide plate or the pressures of the air in said converging gap.

6. Card according to claim 5, wherein the driving means is a manually actuated driving means.

7. Card according to claim 1, wherein the free space is limited through a further air guiding means.

8. Card according to claim 7, wherein the air guiding means slides so that said free space is adjustable in size.

9. Card according to claim 1, wherein said free space is placed under vacuum so that a predetermined vacuum is produced in the free space.

10. Card according to claim 9, wherein said free space is either placed in vacuum or supplied with air.

11. Card according to claim 10, wherein the vacuum of the pressure of the air is adjustable by a control throttle provided between a respective vacuum source or an air pressure source and said free space.

12. Card according to claim 1, wherein said free space is supplied with air so that a predetermined pressure is produced in said free space.

13. Method for correcting the delivery of cylinder to a doffer roll, comprising:

supervising movement of the fiber fleece from the main cylinder to the doffer roll to determine a predetermined movement; and correcting deviations from the predetermined movement, until the predetermined movement is again achieved.

14. Method according to claim 13, wherein the movement is supervised optically by a light source.

15. Method according to claim 14, wherein the movement is supervised visually.

16. Method according to claim 15, wherein the deviation from the predetermined movement is corrected manually.

17. Method according to claim 13, comprising providing at least one window in a card side wall in the space between the main cylinder and the doffer roll, so that the movement of the fiber fleece is supervised through said at least one window.

18. Method according to claim 13, comprising providing a gap adjacent the main cylinder and doffer roll, and adjusting the size of the gap to change the air pressure within the gap, whereby the resulting air flow aids in delivering the fiber fleece to the doffer roll.

19. Method according to claim 18, comprising providing an adjusted air guide plate to guide said resulting air flow.

20. Method according to claim 19, comprising providing a free space immediately following said air guide plate.

21. A card apparatus comprising:

a main cylinder;

a doffer roll for removing fiber from said main cylinder;

a first gap between said main cylinder and said doffer roll, said first gap diverging with respect to a predetermined direction of rotation of said main cylinder;

an air guide plate comprising a surface positioned with respect to said main cylinder to form a second gap with said main cylinder, said second gap converging with resect to said predetermined direction of rotation of said main cylinder, for guiding airflow into said converging gap for assisting removal of the fiber from said main cylinder;

said air guide plate further comprising means for selectively repositioning said surface of said air guide plate toward and away from said main cylinder for affecting said airflow guided into said converging gap.

* * * * *